US011209028B2

(12) United States Patent
Yuan

(10) Patent No.: US 11,209,028 B2
(45) Date of Patent: Dec. 28, 2021

(54) SYSTEM WITH MOTION SENSORS FOR DAMPING MASS-INDUCED VIBRATION IN MACHINES

(71) Applicant: EATON INTELLIGENT POWER LIMITED, Dublin (IE)

(72) Inventor: QingHui Yuan, Edina, MN (US)

(73) Assignee: Eaton Intelligent Power Limited, Dublin (IE)

( * ) Notice: Subject to any disclaimer, the term of this patent is extended or adjusted under 35 U.S.C. 154(b) by 27 days.

(21) Appl. No.: 16/665,511

(22) Filed: Oct. 28, 2019

(65) Prior Publication Data

US 2020/0124062 A1 Apr. 23, 2020

Related U.S. Application Data

(63) Continuation of application No. PCT/US2018/029384, filed on Apr. 25, 2018.
(Continued)

(51) Int. Cl.
*F15B 21/00* (2006.01)
*E04G 21/04* (2006.01)
(Continued)

(52) U.S. Cl.
CPC ..... *F15B 21/008* (2013.01); *E02F 9/2207* (2013.01); *E04G 21/0454* (2013.01);
(Continued)

(58) Field of Classification Search
CPC ..... F15B 21/008; F15B 2211/8613; F15B 2211/8616; E02F 9/2207; E04G 21/0436; E04G 21/0454
See application file for complete search history.

(56) References Cited

U.S. PATENT DOCUMENTS 3,917,246 A 11/1975 Gartner et al.
4,621,375 A 11/1986 Simnovec
(Continued)

FOREIGN PATENT DOCUMENTS

CN 1932215 3/2007
CN 201670158 12/2010
(Continued)

OTHER PUBLICATIONS

International Search Report and Written Opinion of the International Searching Authority for International Patent Application No. PCT/US2018/029384 dated Aug. 9, 2018, 15 pages.
(Continued)

*Primary Examiner* — Michael Leslie
(74) *Attorney, Agent, or Firm* — Merchant & Gould P.C.

(57) ABSTRACT

A system for damping mass-induced vibrations in a machine having a long boom or elongate member, the movement of which causes mass-induced vibration in such boom or elongate member. The system comprises at least one motion sensor operable to measure movement of such boom or elongate member resulting from mass-induced vibration, and a processing unit operable to control a first control valve spool in a pressure control mode and a second control valve spool in a flow control mode in order to adjust the hydraulic fluid flow to the load holding chamber of an actuator attached to the boom or elongate member to dampen the mass-induced vibration. The system further comprises a control manifold fluidically interposed between the actuator and control valve spools that causes the first and second control valve spools to operate, respectively, in pressure and flow control modes.

19 Claims, 5 Drawing Sheets

Related U.S. Application Data

(60) Provisional application No. 62/491,880, filed on Apr. 28, 2017, provisional application No. 62/532,743, filed on Jul. 14, 2017.

(51) Int. Cl.

| | |
|---|---|
| ***F15B 13/01*** | (2006.01) |
| ***F15B 15/20*** | (2006.01) |
| ***F15B 20/00*** | (2006.01) |
| ***E02F 9/22*** | (2006.01) |

(52) U.S. Cl.

CPC ..... *F15B 13/01* (2013.01); *F15B 15/202* (2013.01); *F15B 20/00* (2013.01); *E04G 21/0436* (2013.01); *F15B 2211/8613* (2013.01); *F15B 2211/8616* (2013.01)

(56) References Cited

U.S. PATENT DOCUMENTS

| | | | | |
|---|---|---|---|---|
| 4,896,582 | A | 1/1990 | Tordenmalm et al. | |
| 5,048,296 | A | 9/1991 | Sunamura et al. | |
| 5,191,826 | A | 3/1993 | Brunner | |
| 5,230,272 | A | 7/1993 | Schmitz | |
| 5,245,826 | A | 9/1993 | Roth et al. | |
| 5,571,226 | A | 11/1996 | Kobayashi | |
| 5,640,996 | A | 6/1997 | Schlecht et al. | |
| 5,699,386 | A | 12/1997 | Measor et al. | |
| 5,715,865 | A | 2/1998 | Wilke | |
| 5,784,944 | A | 7/1998 | Tozawa et al. | |
| 5,832,730 | A | 11/1998 | Mizui | |
| 5,996,465 | A | 12/1999 | Morikawa et al. | |
| 6,202,013 | B1 | 3/2001 | Anderson et al. | |
| 6,328,173 | B1 | 12/2001 | Wimmer | |
| 6,634,172 | B2 | 10/2003 | Schoonmaker et al. | |
| 6,883,532 | B2 | 4/2005 | Rau | |
| 7,143,682 | B2 | 12/2006 | Nissing et al. | |
| 7,269,947 | B2 | 9/2007 | Yoshino | |
| 7,278,262 | B2 | 10/2007 | Moon | |
| 7,296,404 | B2 | 11/2007 | Pfaff | |
| 7,729,832 | B2 | 6/2010 | Benckert et al. | |
| 7,845,169 | B2 | 12/2010 | Brickner et al. | |
| 8,037,682 | B2 | 10/2011 | Yi et al. | |
| 8,082,083 | B2 * | 12/2011 | Pirri | E04G 21/04 701/50 |
| 8,925,310 | B2 * | 1/2015 | Pirri | F15B 21/008 60/469 |
| 9,810,242 | B2 | 11/2017 | Wang | |
| 9,933,328 | B2 | 4/2018 | Rannow | |
| 10,036,407 | B2 * | 7/2018 | Rannow | E02F 9/2207 |
| 10,316,929 | B2 * | 6/2019 | Wang | F15B 21/008 |
| 10,323,663 | B2 * | 6/2019 | Wang | F15B 21/008 |
| 10,344,783 | B2 * | 7/2019 | Wang | F15B 21/008 |
| 10,502,239 | B2 | 12/2019 | Wang et al. | |
| 10,605,277 | B2 | 3/2020 | Wang et al. | |
| 10,724,552 | B2 | 7/2020 | Rannow et al. | |
| 11,028,861 | B2 | 6/2021 | Wang | |
| 11,047,406 | B2 | 6/2021 | Wang et al. | |
| 2002/0092417 | A1 | 7/2002 | Suzuki et al. | |
| 2003/0159576 | A1 | 8/2003 | Schoonmaker et al. | |
| 2006/0272325 | A1 | 12/2006 | Moon | |
| 2007/0299589 | A1 | 12/2007 | Gianoglio et al. | |
| 2008/0034957 | A1 | 2/2008 | Stephenson et al. | |
| 2008/0087163 | A1 | 4/2008 | Brickner et al. | |
| 2010/0095835 | A1 | 4/2010 | Yuan et al. | |
| 2010/0186401 | A1 | 7/2010 | Kauss et al. | |
| 2011/0088785 | A1 | 4/2011 | Balasubramania | |
| 2011/0179783 | A1 | 7/2011 | Pirri et al. | |
| 2012/0198832 | A1 | 8/2012 | Fukumoto | |
| 2014/0026548 | A1 | 1/2014 | Vigholm et al. | |
| 2014/0150416 | A1 | 6/2014 | Lee | |
| 2016/0108936 | A1 | 4/2016 | Wang | |
| 2016/0222989 | A1 | 8/2016 | Rannow et al. | |
| 2016/0298660 | A1 | 10/2016 | Wang et al. | |
| 2016/0298719 | A1 | 10/2016 | Wang et al. | |
| 2017/0204886 | A1 | 7/2017 | Wang et al. | |
| 2018/0156243 | A1 | 6/2018 | Wang | |
| 2019/0101137 | A1 | 4/2019 | Rannow et al. | |
| 2020/0003239 | A1 | 1/2020 | Wang et al. | |
| 2020/0032820 | A1 | 1/2020 | Wang et al. | |
| 2020/0124060 | A1 | 4/2020 | Yuan | |
| 2020/0124061 | A1 | 4/2020 | Yuan | |
| 2020/0248720 | A1 | 8/2020 | Wang et al. | |
| 2021/0010490 | A1 | 1/2021 | Rannow et al. | |

FOREIGN PATENT DOCUMENTS

| | | | |
|---|---|---|---|
| CN | 102134909 | | 7/2011 |
| CN | 202322251 | | 7/2012 |
| CN | 102691683 | | 9/2012 |
| CN | 102705288 | | 10/2012 |
| CN | 105593438 | | 5/2016 |
| DE | 102 53 871 | | 8/2004 |
| DE | 20 2009 007 668 | | 10/2009 |
| EP | 0 457 913 | | 11/1991 |
| EP | 1 134 431 | | 5/2005 |
| EP | 2 347 988 | | 7/2011 |
| EP | 2 503 161 | | 9/2012 |
| JP | H05-163746 | | 6/1993 |
| JP | 6-147259 | | 5/1994 |
| JP | 7-113436 | | 5/1995 |
| JP | 7-300881 | | 11/1995 |
| JP | 9-041428 | | 2/1997 |
| JP | 3079498 | | 8/2000 |
| JP | 2003-20197 | | 1/2003 |
| JP | 2004-301214 | | 10/2004 |
| JP | 2004-308746 | | 11/2004 |
| JP | 2006-300280 | | 11/2006 |
| JP | 2009-74692 | | 4/2009 |
| JP | 2012-197937 | | 10/2012 |
| JP | 2013-35527 | | 2/2013 |
| KR | 10-2003-0088425 | A | 11/2003 |
| KR | 10-1190553 | | 10/2012 |
| WO | 2004/088144 | | 10/2004 |
| WO | 2014/193649 | | 12/2014 |
| WO | 2014/193649 | A1 | 12/2014 |
| WO | 2015/031821 | | 3/2015 |
| WO | 2015/031821 | A1 | 3/2015 |
| WO | 2015/073329 | | 5/2015 |
| WO | 2015/073329 | A1 | 5/2015 |
| WO | 2015/073330 | | 5/2015 |
| WO | 2015/073330 | A1 | 5/2015 |
| WO | 2015073330 | | 5/2015 |
| WO | 2014165888 | | 10/2015 |
| WO | 2015/191661 | | 12/2015 |
| WO | 2016/011193 | | 1/2016 |
| WO | 2016/011193 | A1 | 1/2016 |
| WO | 2014/193649 | | 4/2016 |
| WO | 2015/031821 | | 7/2016 |

OTHER PUBLICATIONS

Supplementary EP Search Report and Written Opinion corresponding to EP 18791854.5, dated Jan. 14, 2021.

Extended European Search Report for Application No. 14803575.1 dated Dec. 20, 2016.

Extended European Search Report for corresponding European Patent Application No. 14840792.7 dated May 9, 2017, 5 pages.

Extended European Search Report for Application No. 14862808.4 dated May 17, 2017.

Extended European Search Report for Application No. 14861695.6 dated Jun. 23, 2017.

Extended European Search Report for corresponding European Patent Application No. 15822402.2 dated Mar. 6, 2018, 8 pages.

Honma, K. et al., "Vibration Damping Control for Construction Machinery with a Long Arm Manipulator," Journal of the Robotics Society of Japan (JRSJ), vol. 6, No. 5, pp. 99-102 (Oct. 1988).

International Search Report for corresponding International Patent Application No. PCT/US2014/037879 dated Sep. 22, 2014.

International Search Report for corresponding International Patent Application No. PCT/US2014/053523 dated Dec. 3, 2014.

(56) References Cited

OTHER PUBLICATIONS

International Search Report for corresponding International Patent Application No. PCT/US2014/064646 dated Mar. 12, 2015.
International Search Report for corresponding International Patent Application No. PCT/US2014/064651 dated Feb. 16, 2015.
International Search Report for corresponding International Patent Application No. PCT/US2014/040636 dated Oct. 15, 2015.
International Search Report and Written Opinion of the International Searching Authority for corresponding International Patent Application No. PCT/US2014/040636 dated Oct. 15, 2015, 8 pgs.
Ultronics ZTS16 Control Architecture Overview, Version 1.3, 18 pages (Jul. 2010).
Ultronics ZTS16 User Manual V1.0 (for SW Version 2.3 & OD Version 2.2, 52 pages (Nov. 25, 2009).
European Search Report and Written Opinion corresponding to 18792266.1 dated Jan. 14, 2021.
International Search Report and Written Opinion of the International Searching Authority for International Patent Application No. PCT/US2018/029401 dated Jul. 23, 2018, 18 pages.

* cited by examiner

SYSTEM WITH MOTION SENSORS FOR DAMPING MASS-INDUCED VIBRATION IN MACHINES

CROSS-REFERENCE TO RELATED APPLICATIONS

This application is a Continuation of PCT/US2018/029384, filed on Apr. 25, 2018, which claims the benefit of U.S. Patent Application Ser. No. 62/491,880, filed on Apr. 28, 2017, and claims the benefit of U.S. Patent Application Ser. No. 62/532,743, filed on Jul. 14, 2017, the disclosures of which are incorporated herein by reference in their entireties. To the extent appropriate, a claim of priority is made to each of the above disclosed applications.

FIELD OF THE INVENTION

The present invention relates generally to the field of hydraulic systems and, more particularly, to systems for damping mass-induced vibration in machines.

BACKGROUND

Many of today's mobile and stationary machines include long booms or elongate members that may be extended, telescoped, raised, lowered, rotated, or otherwise moved through the operation of hydraulic systems. Examples of such machines include, but are not limited to: concrete pump trucks having articulated multi-segment booms; fire ladder trucks having extendable or telescoping multi-section ladders; fire snorkel trucks having aerial platforms attached at the ends of articulated multi-segment booms; utility company trucks having aerial work platforms connected to extendable and/or articulated multi-segment booms; and, cranes having elongate booms or extendable multi-segment booms. The hydraulic systems generally comprise a hydraulic pump, one or more linear or rotary hydraulic actuators, and a hydraulic control system including hydraulic control valves to control the flow of hydraulic fluid to and from the hydraulic actuators.

The long booms and elongate members of such machines are, typically, manufactured from high-strength materials such as steel, but often flex somewhat due at least in part to their length and being mounted in a cantilever manner. In addition, the long booms and elongate members have mass and may enter undesirable, mass-induced vibration modes in response to movement during use or external disturbances such as wind or applied loads. Various hydraulic compliance methods have been used in attempts to damp or eliminate the mass-induced vibration. However, such methods are not very effective unless mechanical compliance is also carefully addressed.

Therefore, there is a need in the industry for a system and methods for damping mass-induced vibration in machines having long booms or elongate members that requires little or no mechanical compliance, and that addresses these and other problems, issues, deficiencies, or shortcomings.

SUMMARY

Broadly described, the present invention comprises a system, including apparatuses and methods, for damping mass-induced vibration in machines having long booms or elongate members in which vibration is introduced in response to movement of such booms or elongate members. In one inventive aspect, a plurality of control valve spools are operable to supply hydraulic fluid respectively to a non-loading chamber and load holding chamber of an actuator connected to a boom or elongate member, with a first control valve spool being operable in a pressure control mode and a second control valve spool being operable in a flow control mode. In another inventive aspect, at least one motion sensor is operable to measure the movement of a boom or elongate member corresponding to mass-induced vibration, and with a processing unit, to control the flow of hydraulic fluid to the load holding chamber of a hydraulic actuator to damp mass-induced vibration. In still another inventive aspect, a control manifold is fluidically interposed between a hydraulic actuator and a plurality of control valve spools to cause a first control valve spool to operate in a pressure control mode and a second control valve spool to operate in a flow control mode. In yet another inventive aspect, a control manifold comprises a first part associated with a non-load holding chamber of a hydraulic actuator and a second part associated with a load holding chamber of the hydraulic actuator.

Other inventive aspects, advantages and benefits of the present invention may become apparent upon reading and understanding the present specification when taken in conjunction with the appended drawings.

DETAILED DESCRIPTION OF AN EXAMPLE EMBODIMENT

Figure 1:
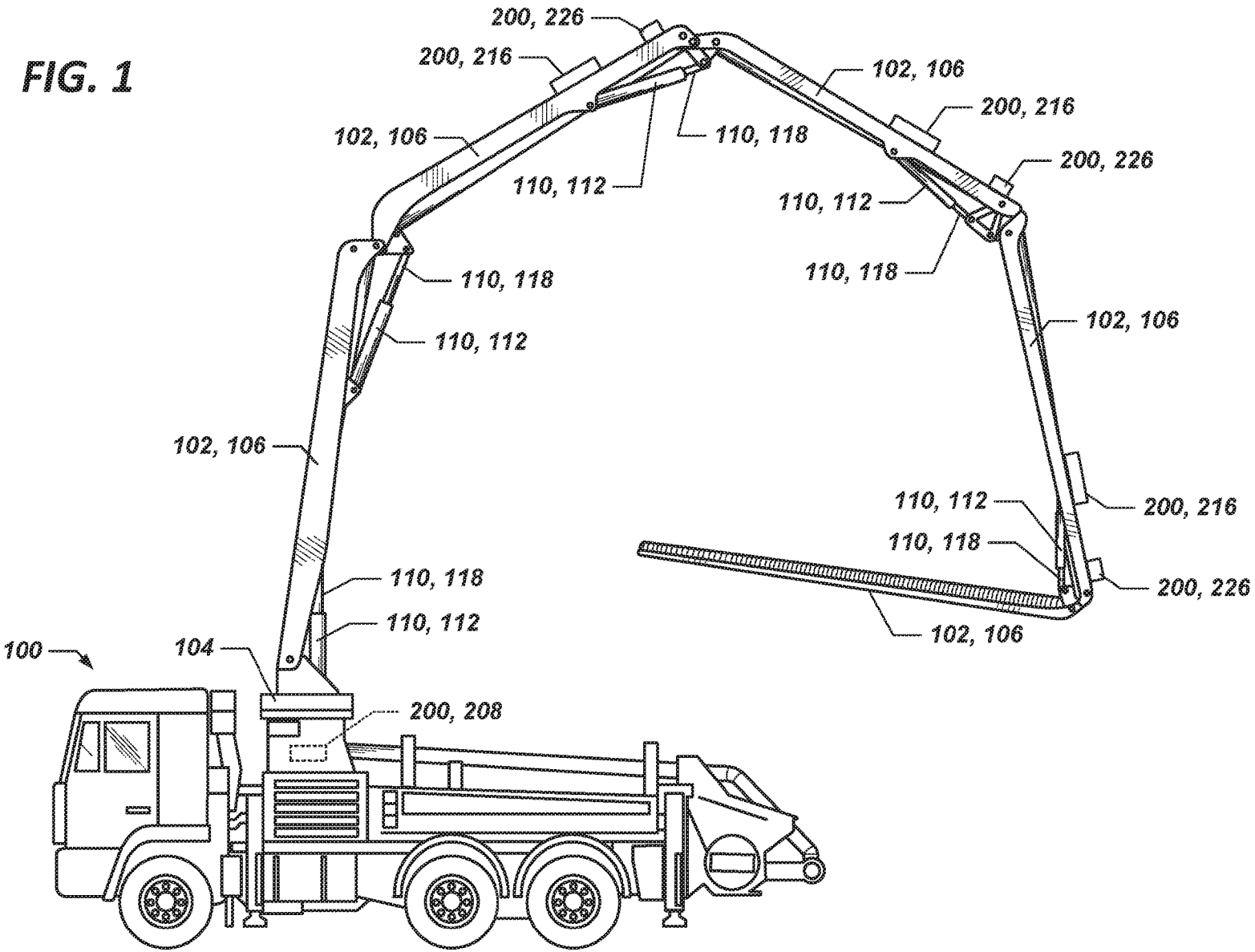
FIG. 1 displays a pictorial view of a machine in the form of concrete pump truck configured with a system for damping mass-induced vibration in accordance with an example embodiment of the present invention.

Referring now to the drawings in which like elements are identified by like numerals throughout the several views, FIG. 1 displays a machine 100 configured with a system for damping mass-induced vibrations 200, including apparatuses and methods, in accordance with the present invention. More specifically, in FIG. 1, the machine 100 comprises a concrete pump truck having an articulated, multi-segment boom 102 that is connected to the remainder of the concrete pump truck by a skewing mechanism 104 that enables rotation of the boom 102 about a vertical axis relative to the remainder of the concrete pump truck. The boom 102 comprises a plurality of elongate boom segments 106 that are pivotally connected by pivot pins 108 in an end-to-end manner. The machine 100 also comprises a plurality of hydraulic actuators 110 that are attached to and between each pair of pivotally connected boom segments 106. The hydraulic actuators 110 generally comprise linear hydraulic actuators operable to extend and contract, thereby causing respective pairs of pivotally connected boom segments 106 to rotate relative to one another about the pivot pin 108 coupling the boom segments 106 together. Each hydraulic actuator 110 has a cylinder 112 and a piston 114 located within the cylinder 112 (see FIGS. 1 and 3). The piston 114 slides within the cylinder 112 and, with the cylinder 112, defines a plurality of chambers 116 for receiving pressurized hydraulic fluid. A rod 118 attached to the piston 114 extends through one the chambers 116, through a wall of the cylinder 112, and is connected to a boom segment 106 to exert forces on the boom segment 106 causing movement of the boom segment 106. A first chamber 116*a* (also sometimes referred to herein as the "non-load holding chamber 116*a*") of the plurality of chambers 116 is located on the rod side of the actuator's piston 114 and a second chamber 116*b* (also sometimes referred to herein as the "load holding chamber 116*b*") of the plurality of chambers 116 is located on the opposite side of the actuator's piston 114. When the entire boom 102 is rotated by the skewing mechanism 104 or when connected boom segments 106 rotated relative to one another about a respective pivot pin 108, vibration is induced in the boom 102 and boom segments 106 because the boom 102 and its boom segments 106 have mass and are being moved relative to the remainder of concrete pump truck or relative to one another.

Before proceeding further, it should be noted that while the system for damping mass-induced vibration 200 is illustrated and described herein with reference to a machine 100 comprising a concrete pump truck having an articulated, multi-segment boom 102, the system for damping mass-induced vibration 200 may be applied to and used in connection with any machine 100 having long booms, elongate members, or other components the movement of which may induce vibration therein. It should also be noted that the system for damping mass-induced vibration 200 may be applied to and used in connection with mobile or stationary machines having long booms, elongate members, or other components in which mass-induced vibration may be introduced by their movement. Additionally, as used herein, the term "hydraulic system" means and includes any system commonly referred to as a hydraulic or pneumatic system, while the term "hydraulic fluid" means and includes any incompressible or compressible fluid that may be used as a working fluid in such a hydraulic or pneumatic system.

Figure 2:
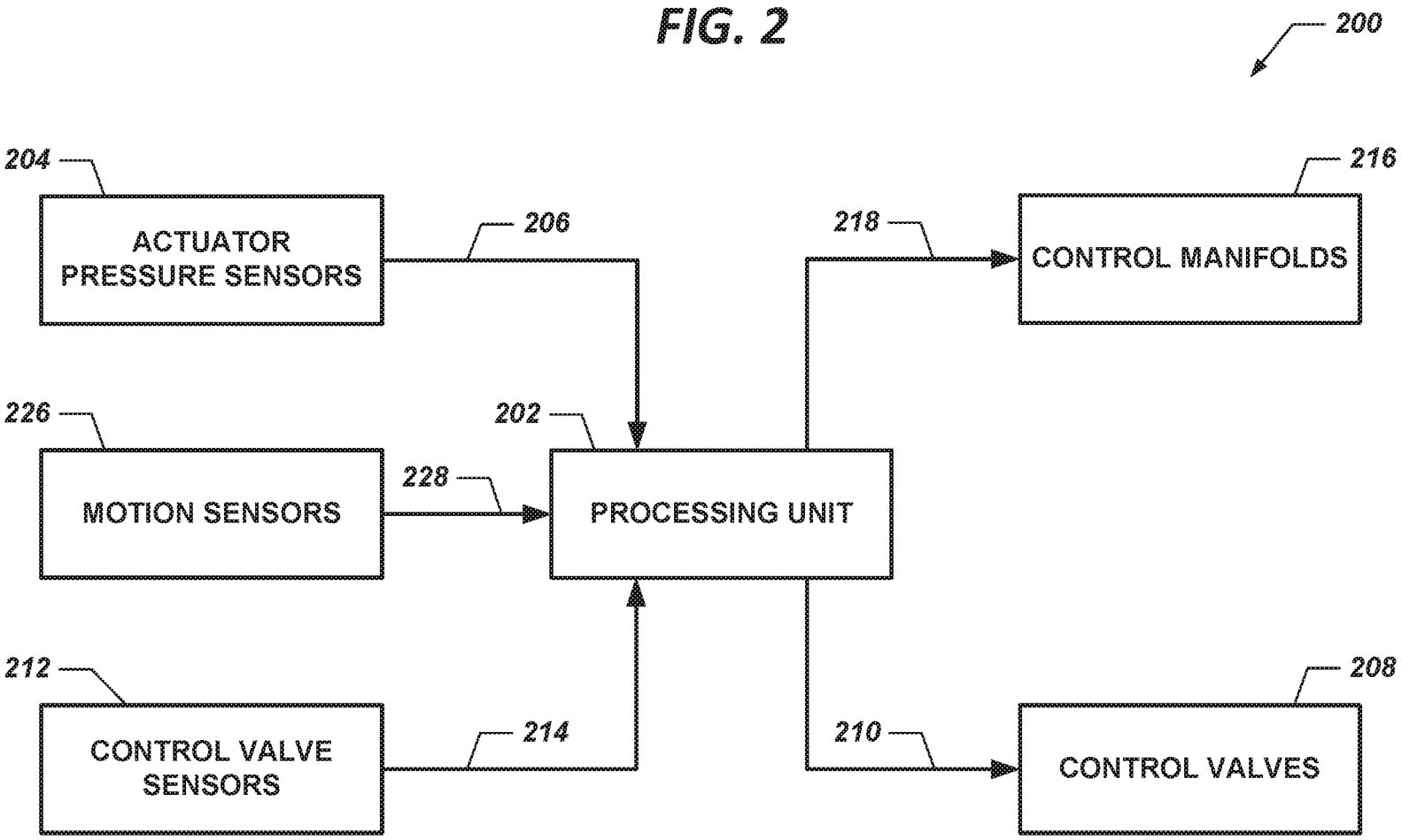
FIG. 2 displays a block diagram representation of the system for damping mass-induced vibration in accordance with the example embodiment of the present invention.

The system for damping mass-induced vibration 200 (also sometimes referred to herein as the "system 200") is illustrated in block diagram form in the block diagram representation of FIG. 2. Since the mass-induced vibration causes the boom 102 and boom segments 106 to vibrate, the system 200 measures the mass-induced vibration by measuring the movement or motion of the boom 102 at strategic locations along the boom 102. Using such measurements and other collected information, the system 102 dampens the mass-induced vibration by controlling the flow of hydraulic fluid to the hydraulic actuators 110 and causing them to extend or contract very slightly to offset the mass-induced vibration.

The system 200 comprises a processing unit 202 operable to execute a plurality of software instructions that, when executed by the processing unit 202, cause the system 200 to implement the system's methods and otherwise operate and have functionality as described herein. The processing unit 202 may comprise a device commonly referred to as a microprocessor, central processing unit (CPU), digital signal processor (DSP), or other similar device and may be embodied as a standalone unit or as a device shared with components of the hydraulic system with which the system 200 is employed. The processing unit 202 may include memory for storing the software instructions or the system 200 may further comprise a separate memory device for storing the software instructions that is electrically connected to the processing unit 202 for the bi-directional communication of the instructions, data, and signals therebetween.

The system for damping mass-induced vibration 200 also comprises a plurality of actuator pressure sensors 204 that are connected to the hydraulic actuators 110. The actuator pressure sensors 204 are arranged in pairs such that a pair of actuator pressure sensors 204 is connected to each hydraulic actuator 110 with the actuator pressure sensors 204 of the pair respectively measuring the hydraulic fluid pressure in the non-load holding and load holding chambers 116*a*, 116*b* on opposite sides of the actuator's piston 114. The actuator pressure sensors 204 are operable to produce and output an electrical signal or data representative of the measured hydraulic fluid pressures. The actuator pressure sensors 204 are connected to processing unit 202 via communication links 206 for the communication of signals or data corresponding to the measured hydraulic fluid pressures. Communication links 206 may communicate the signals or data representative of the measured hydraulic fluid pressures to the processing unit 202 using wired or wireless communication components and methods.

Additionally, the system for damping mass-induced vibration 200 comprises a plurality of control valves 208 that are operable to control pressure and the flow of pressurized hydraulic fluid to respective control manifolds 216 (described below) and, hence, to the respective hydraulic actuators 110 serviced by control manifolds 216 in order to cause the hydraulic actuators 110 to extend or contract. According to an example embodiment, the control valves 208 comprise solenoid-actuated, twin-spool metering control valves and the hydraulic actuators 110 comprise double-acting hydraulic actuators. The control valves 208 each have at least two independently-controllable spools 209*a*, 209*b* (also sometimes referred to herein as "spools 209*a*, 209*b*") such that each control valve 208 is operable to perform two independent functions simultaneously with respect to a hydraulic actuator 110, including, without limitation, pressure control for the non-load holding chamber 116*a* of the hydraulic actuator 110 and damping flow control for the load holding chamber 116*b* of the hydraulic actuator 110. To enable such operation, the spools 209*a*, 209*b* are arranged with one spool 209*a* of a control valve 208 being associated and operable with the non-load holding chamber 116*a* of the hydraulic actuator 110 and the other spool 209*b* of the control valve 208 being associated and operable with the load holding chamber 116*b* of the hydraulic actuator 110. The operation of each spool 209 is independently controlled by processing unit 202 with each control valve 208 and spool 209 being electrically connected to processing unit 202 by a communication link 210 for receiving control signals from the processing unit 202 causing the spools' solenoids to energize or de-energize, thereby correspondingly moving the spools 209 between open, closed, and intermediate positions.

While the system 200 is described herein with each control valve 208 comprising a solenoid-actuated, twin-spool metering control valve having two independently-controllable spools 209*a*, 209*b*, it should, however, be appreciated and understood that control valves 208 may comprise other forms of control valves 208 in other example embodiments that are operable to simultaneously and independently provide, in response to receiving control signals from processing unit 202, pressure control for the non-load holding chamber 116*a* of a hydraulic actuator 110 and damping flow control for the load holding chamber 116*b* of the hydraulic actuator 110. It should also be appreciated and understood that control valves 208 may comprise respective embedded controllers that are operable to communicate with processing unit 202 and to operate with processing unit 202 in achieving the functionality described herein.

In addition, the system for damping mass-induced vibration 200 comprises a plurality of control valve sensors 212 that measure various parameters that are related to and indicative of the operation of respective control valves 208. Such parameters include, but are not limited to, hydraulic fluid supply pressure ($P_s$), hydraulic fluid tank pressure ($P_t$), hydraulic fluid delivery pressure ($P_a$, $P_b$), and control valve spool displacement ($x_a$, $x_b$), where subscripts "a" and "b" correspond to actuator chambers 116*a*, 116*b* and to the first and second control valve spools 209*a*, 209*b* of a control valve 208 configured to operate as described herein. The control valve sensors 212 are generally attached to, or at locations near, respective control valves 208 as appropriate to obtain measurements of the above-identified parameters. The control valve sensors 212 are operable to obtain such measurements and to produce and output signals or data representative of such measurements. Communication links 214 connect the control valve sensors 212 to processing unit 202 for the communication of such output signals or data to processing unit 202, and may utilize wired and/or wireless communication devices and methods for such communication.

According to an example embodiment, the control valves 208, control valve sensors 212, and processing unit 202 are co-located in a single, integral unit. However, it should be appreciated and understood that, in other example embodiments, the control valves 208, control valve sensors 212, and processing unit 202 may be located in multiple units and in different locations. It should also be appreciated and understood that, in other example embodiments, the control valves 208 may comprise independent metering valves not a part of the system 200.

The system for damping mass-induced vibration 200 further comprises a plurality of motion sensors 226 that are fixedly mounted to various boom segments 106 of boom 102. The motion sensors 226 are operable to measure movement of the boom segments 106 resulting at least in part from mass-induced vibration, and to generate and output signals or data representative of such movement. According to the example embodiment, the motion sensors 226 comprise three axis accelerometers generally capable of measuring movement in three spatial dimensions, but it should be appreciated and understood that other motion sensors 226 (such as, but not limited to, one and two axis accelerometers) capable of measuring movement in only one or two spatial dimensions may be used in other applications and other example embodiments. The motion sensors 226 are connected to the processing unit 202 by communication links 228 for the communication of output signals or data corresponding to measured movement to the processing unit 202. Communication links 228 may, in accordance with an example embodiment, comprise structure and utilize methods for communicating such output signals or data via wired and/or wireless technology.

As illustrated in FIGS. 1 and 2, the system for damping mass-induced vibration 200 still further comprises a plurality of control manifolds 216 that are fluidically interposed between the control valves 208 and the hydraulic actuators 110. Generally, a control manifold 216 and a hydraulic actuator 110 are associated in one-to-one correspondence such that the control manifold 216 participates in controlling the flow of pressurized hydraulic fluid delivered from a control valve spool 209*a*, 209*b* to a chamber 116*a*, 116*b* of the hydraulic actuator 110. As a consequence, the control manifold 216 associated with a particular hydraulic actuator 110 is, typically, mounted near the hydraulic actuator 110 (see FIG. 1). Each control manifold 216 is communicatively connected to processing unit 202 via a communication link 218 for receiving signals from processing unit 202 that control operation of the various components of the control manifold 216 according to the methods described herein. The communication links 218 may comprise wired and/or wireless communication links 218 in different example embodiments.

Figure 3:
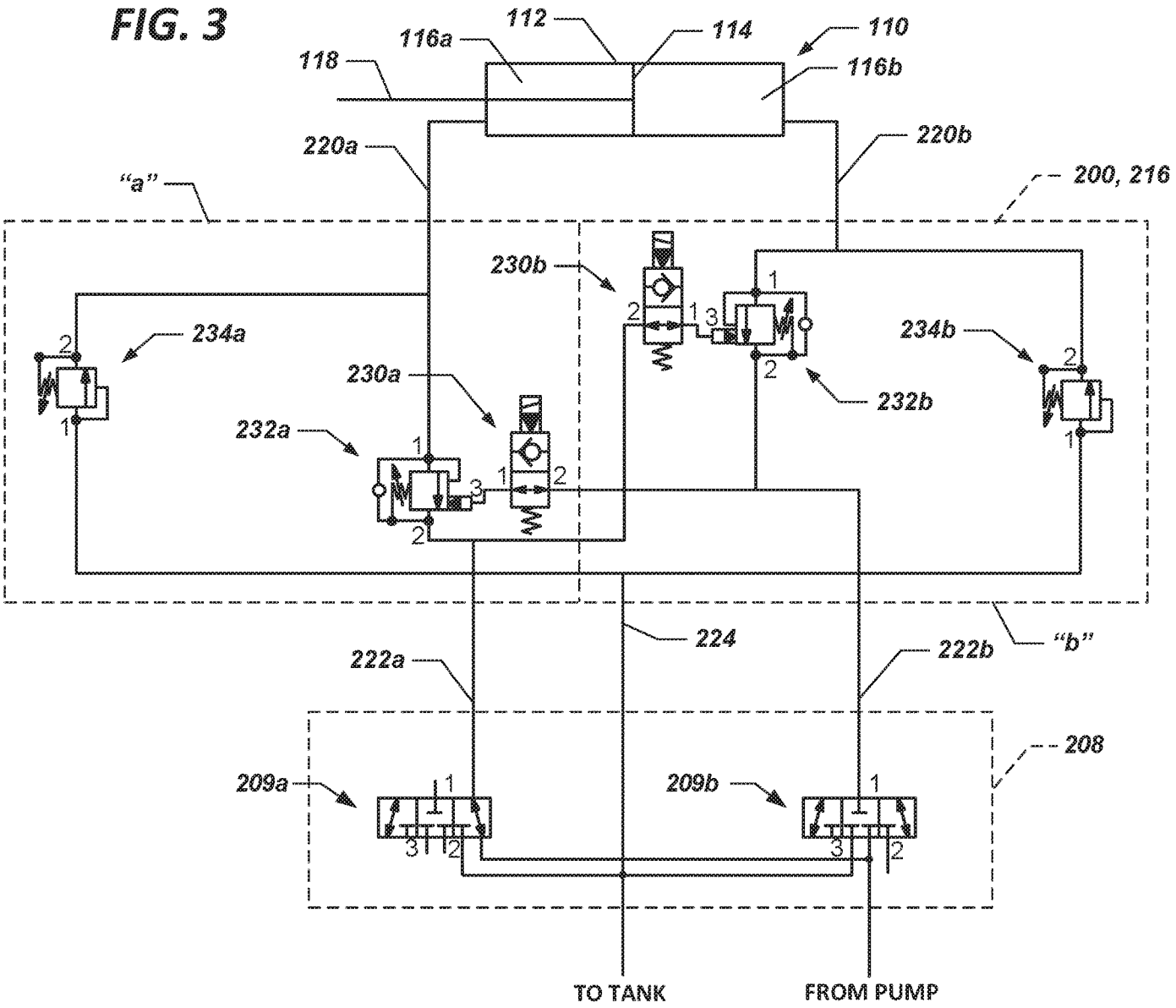
FIG. 3 displays a schematic view of a control manifold of the system for damping mass-induced vibration of FIG. 2.

FIG. 3 displays a schematic view of a control manifold 216, in accordance with an example embodiment, fluidically connected for the flow of hydraulic fluid between a hydraulic actuator 110 and independently-controlled spools 209*a*, 209*b* of a control valve 208. More particularly, the control manifold 216 is connected to the non-load holding chamber 116*a* of hydraulic cylinder 110 for the flow of hydraulic fluid therebetween by hose 220*a*, and is connected to the load holding chamber 116*b* of hydraulic cylinder 110 for the flow of hydraulic fluid therebetween by a hose 220*b*. Additionally, the control manifold 216 is connected to control valve 208 and valve spool 209*a* for the flow of hydraulic fluid therebetween by hose 222*a*, and is connected to control valve 208 and valve spool 209*b* for the flow of hydraulic fluid therebetween by hose 222*b*. In addition, the control manifold 216 is fluidically connected to a hydraulic fluid tank or reservoir (not shown) by a hose 224 for the flow of hydraulic fluid from the control manifold 216 to the hydraulic fluid tank. It should be appreciated and understood that although hoses 220, 222, 224 are used to fluidically connect the control manifold 216 respectively to hydraulic cylinder 110, control valve 208, and a hydraulic fluid tank or reservoir in the example embodiment described herein, the hoses 220, 222, 224 may be replaced in other example embodiments by tubes, conduits, or other apparatuses suitable for conveying hydraulic fluid.

The control manifold 216 comprises isolation valves 230*a*, 230*b*, counterbalance valves 232*a*, 232*b*, and pressure relief valves 234*a*, 234*b* that are arranged in manifold sides "a" and "b" and that are associated and operable, respectively, with the hydraulic actuator's non-load holding chamber 116*a* and load holding chamber 116*b*. As seen in FIG. 3, isolation valve 230*a* is fluidically connected between the pilot port of counterbalance valve 232*a* and the work port of control valve 208 for valve spool 209*b*. The input port of valve spool 209*b* of control valve 208 is fluidically connected to a pump, reservoir, or other source of appropriately pressurized hydraulic fluid. Counterbalance valve 232*a* is fluidically connected between the work port of control valve 208 for valve spool 209*a* and chamber 116*a* of the hydraulic actuator 110. In addition to being fluidically connected to chamber 116*a*, the output port of counterbalance valve 232*a* is fluidically connected to the input port of pressure relief valve 234*a*. The output port of pressure relief valve 234*a* is fluidically connected to a receiving tank or reservoir such that if the pressure of the hydraulic fluid being delivered from counterbalance valve 232*a* to actuator chamber 116*a* has a measure greater than a threshold value, the pressure relief valve 234*a* opens from its normally closed configuration to direct hydraulic fluid to the receiving tank or reservoir.

Similarly, isolation valve 230*b* is fluidically connected between the pilot port of counterbalance valve 232*b* and the work port for valve spool 208*a* of control valve 208. The input port of valve spool 209*a* of control valve 208 is fluidically connected to a pump, reservoir, or other source of appropriately pressurized hydraulic fluid. Counterbalance valve 232*b* is fluidically connected between the work port of control valve 208 for valve spool 209*b* and chamber 116*b* of the hydraulic actuator 110. In addition to being fluidically connected to chamber 116*b*, the output port of counterbalance valve 232*b* is fluidically connected to the input port of pressure relief valve 234*b*. The output port of pressure relief valve 234*b* is fluidically connected to a receiving tank or reservoir such that if the pressure of the hydraulic fluid being delivered from counterbalance valve 232*b* to actuator chamber 116*b* has a measure greater than a threshold value, the pressure relief valve 234*b* opens from its normally closed configuration to direct hydraulic fluid to the receiving tank or reservoir.

The counterbalance valves 232*a*, 232*b*, according to an example embodiment, have a high pressure ratio and are capable of being opened with a relatively low pilot pressure. The pilot pressure to counterbalance valves 232*a*, 232*b* is controlled, respectively, by isolation valves 230*a*, 230*b* together with valve spools 209*a*, 209*b* of control valve 208. By default, electric current is not supplied to the isolation valves 230*a*, 230*b* and the isolation valves 230*a*, 230*b* allow hydraulic fluid to flow therethrough. The valve spools 209 of control valves 208 are operable in pressure control, flow control, spool position control, and in various other modes.

Figure 4:
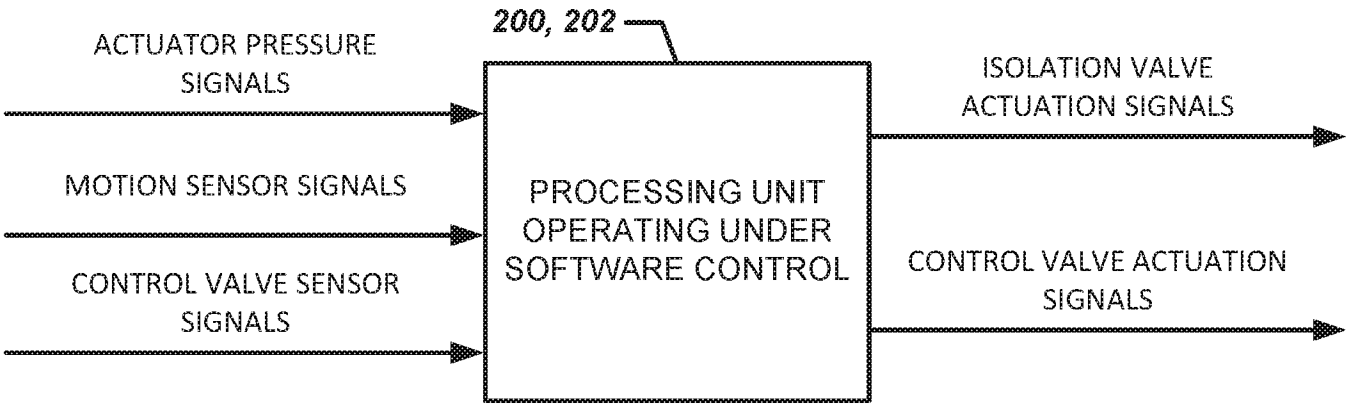
FIG. 4 displays a control diagram representation of the control methodology used by the system for damping mass-induced vibration.

During operation of the system for damping mass-induced vibration 200 and as illustrated in control diagram of FIG. 4, the actuator pressure sensors 204 produce electrical signals or data representative of the pressure of the hydraulic fluid present in actuator chambers 116*a*, 116*b*. Also, the control valve sensors 212 produce electrical signals or data representative of the hydraulic fluid supply pressure ($P_s$) to control valves 208, hydraulic fluid tank pressure ($P_t$), hydraulic fluid delivery pressure ($P_a$, $P_b$) at the work ports of control valves 208, and the spool displacement ($x_a$, $x_b$) of the spools 209*a*, 209*b* of control valves 208. Additionally, motion sensors 226 produce electrical signals or data corresponding to measured movement of the boom segments 206 to which the motion sensors 226 are attached. The processing unit 202 receives the signals or data from actuator pressure sensors 204, control valve sensors 212, and motion sensors 226 via communication links 206, 214, 228. Operating under the control of stored software instructions and based on the received input signals or data, the processing unit 202 generates output signals or data for delivery to the isolation valves 230*a*, 230*b* and valve spools 209*a*, 209*b* of control valves 208 via communication links 218, 210, respectively. More particularly, the processing unit 202 produces separate actuation signals or data to cause the turning on or off of isolation valves 230*a*, 230*b* and to adjust the operation of valve spools 209 of control valves 208 in accordance with the methods described herein.

Figure 5:
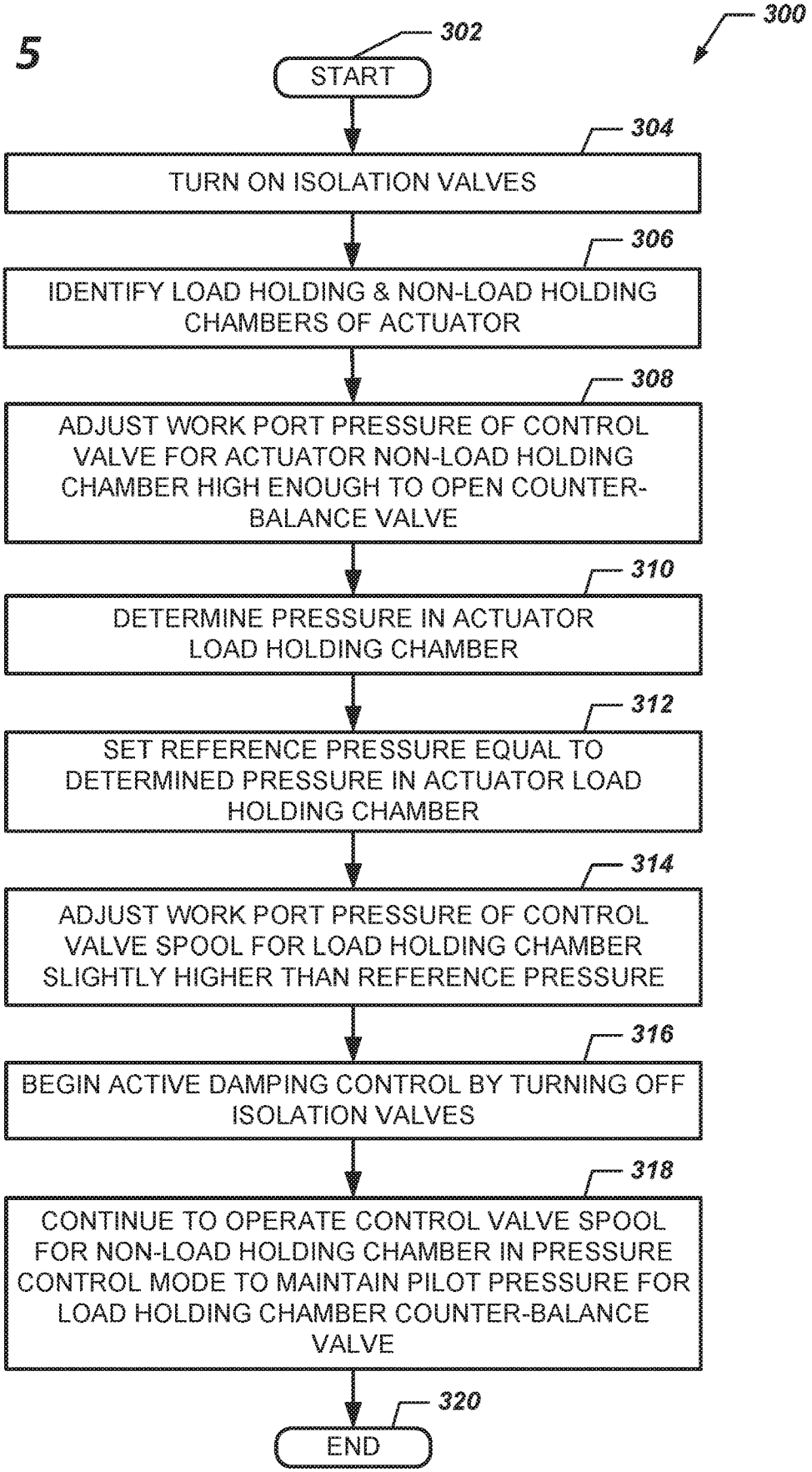
FIG. 5 displays a flowchart representation of a method for damping mass-induced vibration in accordance with the example embodiment of the present invention.

The system 200 operates in accordance with a method 300 illustrated in FIG. 5 to damp mass-induced vibration. Operation according to method 300 starts at step 302 and proceeds to step 304 where the isolation valves 230 are initialized to an "on" state by the processing unit 202 generating respective isolation valve actuation signals that cause electrical current to be supplied to the isolation valves 230. In such "on" state, the isolation valves 230 stop the flow of hydraulic fluid to the pilot port of respective counterbalance valves 232, causing the counterbalance valves 232 to be closed to the flow of hydraulic fluid therethrough. Next, at step 306, the processing unit 202 identifies the non-load holding and load holding chambers 116*a*, 116*b* of hydraulic actuator 110 based on the pressures measured for each actuator chamber 116. To do so, the processing unit 202 uses the actuator pressure signals received from the actuator pressure sensors 204 for each chamber 116 and the known dimensions and area of the piston 114 and rod 118.

Continuing at step 308 of method 300, the work port pressure ($P_a$) for the valve spool 209*a* associated with non-load holding chamber 116*a* is adjusted to be high enough to open counterbalance valve 232*b*. The adjustment is made by the processing unit 202 generating and outputting appropriate signals or data to valve spool 209*a* and control valve 208 via a communication link 210. According to an example embodiment, such work port pressure may be approximately 20 bar. Then, at step 310, the processing unit 202 determines the pressure present in the actuator's load holding chamber 116*b* by using actuator pressure signals received from the actuator pressure sensor 204 for chamber 116*b* and the known dimensions and area of the piston 114. Subsequently, at step 312, the processing unit 202 sets a reference pressure equal to the determined pressure of the hydraulic fluid in the load holding chamber 116*b*. The processing unit 202 then, at step 314, causes adjustment of the work port pressure ($P_b$) of the load holding chamber 116*b* to be slightly higher than the reference pressure. To do so, the processing unit 202 generates and outputs appropriate signals or data to valve spool 209*b* of control valve 208 via a communication link 210.

At step 316 and after hydraulic fluid pressures stabilize, active damping control is begun by setting the isolation valves 230*a*, 230*b* to an "off" state. The processing unit 202 sets the isolation valves 230*a*, 230*b* in the "off" state by generating and outputting a signal or data on respective communication links 218 that is appropriate to cause no electrical current to be supplied to the isolation valves 230*a*, 230*b*. In such "off" state, hydraulic fluid flows through the isolation valves 230*a*, 230*b* and to the pilot ports of the respective counterbalance valves 232*a*, 232*b*, resulting in the counterbalance valves 232*a*, 232*b* opening for the flow of hydraulic fluid therethrough because the controlled pressures are high enough to maintain the counterbalance valves 232*a*, 232*b* open. Next, at step 318, valve spool 209*a* of control valve 208 continues to operate in pressure control mode to build sufficient pilot pressure for counterbalance valve 232*b*, and valve spool 209*b* of control valve 208 operates in flow control mode. In flow control mode, the flow rate of hydraulic fluid from valve spool 209*b* of control valve 208 is related to the perturbation of motion sensor measurements and is given by:

$$Qb(t)=-k\cdot\int_0^t F_a\,dt$$

where: k is the gain for flow control;

$F_a$ is the perturbation of the motion sensor measurements around a mean value.

The perturbation of the motion sensor measurements should be associated with the key vibration mode. Therefore, it may be necessary to filter the motion sensor signals using one or more band pass filters to remove the mean value not associated with the key vibration mode. With valve spool 209*a* of control valve 208 operating in pressure control mode and valve spool 209*b* of control valve 208 operating in flow control mode, the method 300 ends at step 320.

Whereas the present invention has been described in detail above with respect to an example embodiment thereof, it should be appreciated that variations and modifications might be effected within the spirit and scope of the present invention.

EXAMPLES

Illustrative examples of the apparatus disclosed herein are provided below. An example of the apparatus may include any one or more, and any combination of, the examples described below.

Example 1

In combination with, or independent thereof, any example disclosed herein, an apparatus for damping mass-induced vibration in a machine including an elongate member and a hydraulic actuator configured to move the elongate member and having a non-load holding chamber and a load holding chamber that includes a motion sensor that is operable to measure movement of the elongate member resulting from mass-induced vibration. The apparatus includes a plurality of control valve spools that are operable to supply variable flow rates of hydraulic fluid to the hydraulic actuator. The apparatus includes a control manifold fluidically interposed between the hydraulic actuator and the plurality of control valve spools. The apparatus includes a processing unit that is operable with the control manifold to control the flow of hydraulic fluid to the hydraulic actuator based at least in part on measurements of movement of the elongate member received from the motion sensor.

Example 2

In combination with, or independent thereof, any example disclosed herein, the motion sensor comprises a first motion sensor located at a first location along the elongate member and the apparatus further comprises a second motion sensor located at a second location along the elongate member. The second location is different from the first location.

Example 3

In combination with, or independent thereof, any example disclosed herein, the apparatus further comprises a plurality of control valve sensors that are operable to measure the pressure of hydraulic fluid exiting the control valve spools. The control manifold is further operable to control the flow of hydraulic fluid to the hydraulic actuator.

Example 4

In combination with, or independent thereof, any example disclosed herein, the processing unit is further operable to produce signals for adjusting the flow rate of hydraulic fluid from the control valve spools.

Example 5

In combination with, or independent thereof, any example disclosed herein, the apparatus further comprises a plurality of control valve sensors operable to determine the displacement of the control valve spools. The processing unit is operable to produce signals for adjusting the flow rate of hydraulic fluid from the control valve spools based at least in part on the displacement.

Example 6

In combination with, or independent thereof, any example disclosed herein, the control manifold includes a first isolation valve that is operable to deliver pilot hydraulic fluid at a pilot pressure. The control manifold includes a first counterbalance valve fluidically connected to the first isolation valve for receiving pilot hydraulic fluid from the first isolation valve. The first counterbalance valve is fluidically connected to the non-load holding chamber of the hydraulic actuator and is operable to deliver hydraulic fluid to the non-load holding chamber of the hydraulic actuator. The control manifold includes a second isolation valve that is operable to deliver pilot hydraulic fluid at a pilot pressure. The control manifold includes a second counterbalance valve that is fluidically connected to the second isolation valve for receiving pilot hydraulic fluid from the second isolation valve. The second counterbalance valve is fluidically connected to the non-load holding chamber of the hydraulic actuator and is operable to deliver hydraulic fluid to the load holding chamber of the hydraulic actuator.

Example 7

In combination with, or independent thereof, any example disclosed herein, the plurality of control valve spools includes a first control valve spool that is fluidically connected to the first counterbalance valve and to the second isolation valve. The first control valve spool is operable to supply hydraulic fluid at a first pressure to the first counterbalance valve and the second isolation valve. The plurality of control valve spools includes a second control valve spool that is fluidically connected to the second counterbalance valve and to the first isolation valve. The second control valve spool is operable to supply hydraulic fluid at a second pressure to the second counterbalance valve and the first isolation valve.

Example 8

In combination with, or independent thereof, any example disclosed herein, a first control valve spool of the plurality of control valve spools is operable in pressure control mode. A second control valve spool of the plurality of control valve spools is operable in flow control mode.

Example 9

In combination with, or independent thereof, any example disclosed herein, the plurality of control valve spools are operable to simultaneously achieve different functions.

Example 10

In combination with, or independent thereof, any example disclosed herein, a first control valve spool of the plurality of control valve spools is operable with the non-load holding chamber of the hydraulic actuator. A second control valve spool of the plurality of control valve spools is operable with the load holding chamber of the hydraulic actuator.

Example 11

In combination with, or independent thereof, any example disclosed herein, the control valve spools comprise independently operable control valve spools of a metering valve.

Example 12

In combination with, or independent thereof, any example disclosed herein, an apparatus for damping mass-induced vibration in a machine including an elongate member and a hydraulic actuator configured to move the elongate member, the hydraulic actuator has a non-load holding chamber and a load holding chamber, the apparatus includes a first isolation valve that is operable to deliver pilot hydraulic fluid at a pilot pressure. The apparatus includes a first counterbalance valve that is fluidically connected to the first isolation valve for receiving pilot hydraulic fluid from the first isolation valve. The first counterbalance valve is fluidically connected to the non-load holding chamber of the hydraulic actuator and is operable to deliver hydraulic fluid to the non-load holding chamber of the hydraulic actuator. The apparatus includes a second isolation valve operable to deliver pilot hydraulic fluid at a pilot pressure. The apparatus includes a second counterbalance valve that is fluidically connected to the second isolation valve for receiving pilot hydraulic fluid from the second isolation valve. The second counterbalance valve is fluidically connected to the non-load holding chamber of the hydraulic actuator and is operable to deliver hydraulic fluid to the load holding chamber of the hydraulic actuator. The apparatus includes a first control valve spool that is fluidically connected to the first counterbalance valve and to the second isolation valve. The first control valve spool is operable to supply hydraulic fluid at a first pressure to the first counterbalance valve and the second isolation valve. The apparatus includes a second control valve spool that is fluidically connected to the second counterbalance valve and to the first isolation valve. The second control valve spool is operable to supply hydraulic fluid at a second pressure to the second counterbalance valve and the first isolation valve. The apparatus includes a processing unit that is operable to generate and output signals causing independent actuation of the first and second isolation valves and independent actuation of the first and second control valve spools, and causing the first control valve spool to operate in pressure control mode and the second control valve spool to operate in flow control mode.

Example 13

In combination with, or independent thereof, any example disclosed herein, the first pressure has a measure sufficient for operation of the second counterbalance valve.

Example 14

In combination with, or independent thereof, any example disclosed herein, the second pressure has a measure sufficient for actuation of the hydraulic actuator.

Example 15

In combination with, or independent thereof, any example disclosed herein, the apparatus includes a motion sensor operable to measure movement of the elongate member. The processing unit is further operable to receive measurements of the movement from the motion sensor and to generate and output signals controlling the flow of hydraulic fluid to the hydraulic actuator based at least in part on the received measurements.

Example 16

In combination with, or independent thereof, any example disclosed herein, the flow rate of hydraulic fluid to the hydraulic actuator to dampen mass-induced vibration is related to the measured movement of the elongate member.

Example 17

In combination with, or independent thereof, any example disclosed herein, the flow rate of hydraulic fluid to the hydraulic actuator is calculated as the mathematical product of a constant selected based at least on a desired damping rate and the integral of forces corresponding to the movement measured by the motion sensor.

Example 18

In combination with, or independent thereof, any example disclosed herein, the first control valve spool is operable independently of the second control valve spool.

Example 19

In combination with, or independent thereof, any example disclosed herein, the first control valve spool is operable in pressure control mode simultaneously while the second control valve spool is operable in flow control mode.

Example 20

In combination with, or independent thereof, any example disclosed herein, the first control valve spool and the second control valve spool comprise control valve spools of a single metering control valve.

What is claimed is:

1. An apparatus for damping mass-induced vibration in a machine including an elongate member and a hydraulic actuator configured to move the elongate member and having a non-load holding chamber and a load holding chamber, said apparatus comprising:

a motion sensor configured for mounting to the elongate member and operable to measure movement of the elongate member resulting from mass-induced vibration;

a plurality of control valve spools operable to supply variable flow rates of hydraulic fluid to the hydraulic actuator, the plurality of control valve spools including independently-controllable first and second control valve spools;

a control manifold fluidically interposed between the hydraulic actuator and said plurality of control valve spools; and a processing unit operable with said control manifold to control the flow of hydraulic fluid to the hydraulic actuator based at least in part on measurements of movement of the elongate member received from the motion sensor, the processing unit operating the first and second control valve spools such that the control valve spool associated with the load holding chamber of the hydraulic actuator is operated in a damping flow control mode and such that the control valve spool associated with the non-load holding chamber of the hydraulic actuator is operated in a pressure control mode;

wherein, when in the damping flow control mode, the processing unit receives measurements of the movement from said motion sensor for use as a variable in calculating a flow rate value for the flow control mode of the second control valve spool.

2. The apparatus of claim 1, wherein said motion sensor comprises a first motion sensor located at a first location along the elongate member and said apparatus further comprises a second motion sensor located at a second location along the elongate member, said second location being different from said first location.

3. The apparatus of claim 1, wherein said apparatus further comprises a plurality of control valve sensors operable to measure the pressure of hydraulic fluid exiting said control valve spools, and wherein said control manifold is further operable to control the flow of hydraulic fluid to the hydraulic actuator.

4. The apparatus of claim 1, wherein said processing unit is further operable to produce signals for adjusting the flow rate of hydraulic fluid from said control valve spools.

5. The apparatus of claim 4, wherein said apparatus further comprises a plurality of control valve sensors operable to determine the displacement of said control valve spools, and wherein said processing unit is operable to produce signals for adjusting the flow rate of hydraulic fluid from said control valve spools based at least in part on said displacement.

6. The apparatus of claim 1, wherein said control manifold includes:

a first isolation valve operable to deliver pilot hydraulic fluid at a pilot pressure;

a first counterbalance valve fluidically connected to said first isolation valve for receiving pilot hydraulic fluid from said first isolation valve, said first counterbalance valve being fluidically connected to the non-load holding chamber of the hydraulic actuator and being operable to deliver hydraulic fluid to the non-load holding chamber of the hydraulic actuator;

a second isolation valve operable to deliver pilot hydraulic fluid at a pilot pressure; and a second counterbalance valve fluidically connected to said second isolation valve for receiving pilot hydraulic fluid from said second isolation valve, said second counterbalance valve being fluidically connected to the load holding chamber of the hydraulic actuator and being operable to deliver hydraulic fluid to the load holding chamber of the hydraulic actuator.

7. The apparatus of claim 6, wherein the first control valve spool is fluidically connected to said first counterbalance valve and to said second isolation valve, said first control valve spool being operable to supply hydraulic fluid at a first pressure to said first counterbalance valve and said second isolation valve; and wherein the second control valve spool is fluidically connected to said second counterbalance valve and to said first isolation valve, said second control valve spool being operable to supply hydraulic fluid at a second pressure to said second counterbalance valve and said first isolation valve.

8. The apparatus of claim 1, wherein said plurality of control valve spools are operable to simultaneously achieve different functions.

9. The apparatus of claim 1, wherein said control valve spools comprise independently operable control valve spools of a metering valve.

10. The apparatus of claim 1, wherein the flow rate value is calculated as a function of a perturbation of motion sensor measurements around a mean value.

11. An apparatus for damping mass-induced vibration in a machine including an elongate member and a hydraulic actuator configured to move the elongate member, the hydraulic actuator having a non-load holding chamber and a load holding chamber, said apparatus comprising:

a first isolation valve operable to deliver pilot hydraulic fluid at a pilot pressure;

a first counterbalance valve fluidically connected to said first isolation valve for receiving pilot hydraulic fluid from said first isolation valve, said first counterbalance valve being fluidically connected to the non-load holding chamber of the hydraulic actuator and being operable to deliver hydraulic fluid to the non-load holding chamber of the hydraulic actuator;

a second isolation valve operable to deliver pilot hydraulic fluid at a pilot pressure;

a second counterbalance valve fluidically connected to said second isolation valve for receiving pilot hydraulic fluid from said second isolation valve, said second counterbalance valve being fluidically connected to the load holding chamber of the hydraulic actuator and being operable to deliver hydraulic fluid to the load holding chamber of the hydraulic actuator;

a first control valve spool fluidically connected to said first counterbalance valve and to said second isolation valve, said first control valve spool being operable to supply hydraulic fluid at a first pressure to said first counterbalance valve and said second isolation valve;

a second control valve spool fluidically connected to said second counterbalance valve and to said first isolation valve, said second control valve spool being operable to supply hydraulic fluid at a second pressure to said second counterbalance valve and said first isolation valve;

a motion sensor configured for mounting to the elongate member and operable to measure movement of the elongate member resulting from mass-induced vibration; and a processing unit operable to generate and output signals causing independent actuation of said first and second isolation valves and independent actuation of said first and second control valve spools, and causing said first control valve spool to operate in a pressure control mode and said second control valve spool to operate in a flow control mode in which the processing unit receives measurements of the movement from said motion sensor for use as a variable in calculating a flow rate value for the flow control mode of the second control valve spool.

12. The apparatus of claim 11, wherein the flow rate value is calculated as a function of a perturbation of motion sensor measurements around a mean value.

13. The apparatus of claim 12, wherein said first pressure has a measure sufficient for operation of said second counterbalance valve.

14. The apparatus of claim 12, wherein said second pressure has a measure sufficient for actuation of the hydraulic actuator.

15. The apparatus of claim 12, wherein a flow rate of hydraulic fluid to the hydraulic actuator to dampen mass-induced vibration is related to the measured movement of the elongate member.

16. The apparatus of claim 15, wherein the flow rate of hydraulic fluid to the hydraulic actuator is calculated as a mathematical product of a constant selected based at least on a desired damping rate and an integral of forces corresponding to the movement measured by said motion sensor.

17. The apparatus of claim 12, wherein said first control valve spool is operable independently of said second control valve spool.

18. The apparatus of claim 12, wherein said first control valve spool is operable in the pressure control mode simultaneously while said second control valve spool is operable in the flow control mode.

19. The apparatus of claim 12, wherein said first control valve spool and said second control valve spool comprise control valve spools of a single metering control valve.

* * * * *